US007407256B2

(12) United States Patent
Han

(10) Patent No.: US 7,407,256 B2
(45) Date of Patent: Aug. 5, 2008

(54) METHOD AND APPARATUS TO COMPENSATE FOR DEFECTIVE NOZZLE OF INKJET IMAGE FORMING DEVICE

(75) Inventor: Eun-bong Han, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 153 days.

(21) Appl. No.: 11/528,546

(22) Filed: Sep. 28, 2006

(65) Prior Publication Data

US 2007/0176953 A1 Aug. 2, 2007

(30) Foreign Application Priority Data

Feb. 2, 2006 (KR) ..... 10-2006-0010051

(51) Int. Cl.
*B41J 29/393* (2006.01)

(52) U.S. Cl. ..... 347/19; 347/15

(58) Field of Classification Search ..... 347/15, 347/19, 12, 41; 358/1.2, 1.9
See application file for complete search history.

(56) References Cited

U.S. PATENT DOCUMENTS 5,124,720 A * 6/1992 Schantz ..... 347/19
5,581,284 A 12/1996 Hermanson
5,587,730 A * 12/1996 Karz ..... 347/43
6,056,454 A 5/2000 Plumley et al.
6,174,039 B1 * 1/2001 Miyake et al. ..... 347/12
6,540,419 B2 4/2003 Plumley et al.

FOREIGN PATENT DOCUMENTS

JP 56-078981 6/1981
KR 10-0251123 1/2000

* cited by examiner

*Primary Examiner*—Lamson D. Nguyen
(74) *Attorney, Agent, or Firm*—Stanzione & Kim, LLP

(57) ABSTRACT

A method to compensate for a degradation of print image quality generated by a defective nozzle, from which no ink or less than a design specification required amount of ink is ejected, in an inkjet image forming device includes moving a printer head a moving distance in a scanning direction, shifting image data corresponding to nozzles of the printer head in a direction opposite to the moving direction of the printer head by the number of nozzles corresponding to the moving distance of the printer head, and printing an image by driving the nozzles according to the shifted image data, and an apparatus to compensate for a degradation of print image quality generated by a defective nozzle, from which no ink or less than a design specification required amount of ink is ejected.

25 Claims, 10 Drawing Sheets

METHOD AND APPARATUS TO COMPENSATE FOR DEFECTIVE NOZZLE OF INKJET IMAGE FORMING DEVICE

CROSS-REFERENCE TO RELATED APPLICATIONS

This application claims priority under 35 U.S.C. §119(a) from Korean Patent Application No. 10-2006-0010051, filed on Feb. 2, 2006, in the Korean Intellectual Property Office, the disclosure of which is incorporated herein in its entirety by reference.

BACKGROUND OF THE INVENTION

1. Field of the Invention

The present general inventive concept relates to an inkjet image forming device, and more particularly, to a method and apparatus to compensate for a degradation of image quality generated by a defective nozzle of the inkjet image forming device.

2. Description of the Related Art

In general, inkjet image forming devices are devices used to form images by ejecting ink from a printer head moving in a direction perpendicular to a feeding direction of a print medium and being separated from the print medium by a predetermined distance. Such an image forming device printing images by ejecting ink onto a print medium while moving in the direction perpendicular to the feeding direction of the print medium is referred to as a shuttle inkjet image forming device. A printer head used in shuttle inkjet image forming devices includes a nozzle module containing a plurality of nozzles for ejecting ink.

Recently, high-speed printing has been performed using printer heads having a nozzle module of a length equal to a width of the print medium instead of using a printer head which shuttles in the width direction of the print medium. An image forming device using this method is referred to as a line printing inkjet image forming device. In the line printing inkjet image forming device, the printer head is fixed, and only the print medium is fed (i.e., only the print medium moves). Thus, a driving apparatus of the line printing inkjet image forming device is simpler, and as a result, higher-speed printing can be realized.

FIG. 1 is a diagram illustrating a print pattern obtained when a defective nozzle is included in a nozzle module of a conventional line printing inkjet image forming device, and FIGS. 2A through 2D are diagrams illustrating a process of compensating for the defective nozzle included in the conventional line printing inkjet image forming device illustrated in FIG. 1.

Referring to FIG. 1, the conventional line printing inkjet image forming device prints an image by ejecting ink I from a plurality of nozzles 82 included in a nozzle module 80. When a specific nozzle 84 of the nozzle module 80 is damaged (i.e., a defective nozzle 84), a line corresponding to the defective nozzle 84 is not printed on the print medium, as illustrated in FIG. 1, since the ink I is not properly ejected onto a print medium from the defective nozzle 84. That is, when a portion of the plurality of nozzles 82 is damaged, since the ink I is not ejected onto a portion of the print medium corresponding to the defective nozzle 84, a white band, such as a missing line, occurs in the print image printed on the print medium. Since the white band in the print image printed on the print medium is easily recognized, the white band significantly affects print quality. A conventional method of compensating for a degradation of image quality due to a defective nozzle, as illustrated in FIGS. 2A through 2D, is disclosed in U.S. Pat. No. 5,581,284.

Specifically, when a defective nozzle is present in an inkjet image forming device, the conventional method disclosed in U.S. Pat. No. 5,581,284 can be used to compensate for the defective nozzle. Here, the defective nozzle is a nozzle which cannot normally eject ink, such as a missing nozzle which cannot eject ink or a weak nozzle whose ejection function has become weakened. According to U.S. Pat. No. 5,581,284, if a defective nozzle 63 (see FIG. 2A) of a mono, i.e., black, color is detected, and if the defective nozzle 63 must be used, other colors, i.e., cyan, magenta, and yellow, are sequentially printed in an area in which the defective nozzle 63 should print. These procedures are illustrated in FIGS. 2B, 2C, and 2D. If cyan, magenta, and yellow are printed on the same location corresponding to the defective nozzle, a black color can be generated to compensate for a defective black nozzle. This black color generated by printing cyan, magenta, and yellow on the same location is referred to as process black or composite black. However, this method cannot be used when a nozzle ejecting a color other than black (e.g., cyan, magenta, or yellow) is damaged. In addition, when any one of three nozzles (e.g., one of a cyan nozzle, a magenta nozzle, or a yellow nozzle) used to compensate for the defective black nozzle (i.e., by printing cyan, magenta, and yellow on the same location) is also damaged, an undesired color is printed, such as red (yellow+magenta, when the cyan nozzle is also defective), green (cyan+yellow, when the magenta nozzle is also defective), or blue (cyan+magenta, when the yellow nozzle is also defective), which contrasts strongly with process black, thereby significantly affecting print image quality. Thus, it is necessary to improve the image quality by compensating for the defective nozzle.

SUMMARY OF THE INVENTION

The present general inventive concept provides a method and apparatus to compensate for a degradation of image quality generated by a defective nozzle of an inkjet image forming device in order to improve print image quality.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept may be achieved by providing a method of compensating for a defective nozzle of an inkjet image forming device, the method including moving a printer head by a predetermined distance in a scanning direction, shifting image data corresponding to nozzles of the printer head in a direction opposite to the moving direction of the printer head by a number of nozzles corresponding to the predetermined moving distance of the printer head, and printing an image by driving the nozzles according to the shifted image data.

The method may further include detecting an initial position of the printer head before the printer head moves, wherein the shifting of the image data includes detecting a current position of the printer head after the printer head moves, calculating a difference between the detected initial position and the detected current position, and shifting the image data by a number of nozzles corresponding to the calculated positional difference.

The shifting of the image data by the number of nozzles corresponding to the calculated positional difference may include generating shift pulses corresponding to the calculated positional difference, and shifting the image data using the generated shift pulses.

The method may further comprise repeating the moving of the printer head, the shifting of the image data, and the printing of the image operations in units of print lines until all print lines of the image are printed.

The foregoing and/or other aspects and utilities of the present general inventive concept may also be achieved by providing an apparatus to compensate for a degredation of print image quality due to a defective nozzle of an inkjet image forming device, the apparatus including a head vibration unit to move a printer head a predetermined distance in a scanning direction, and a data adjuster to shift image data to be printed corresponding to nozzles of the printer head in a direction opposite to the moving direction of the printer head by a number of nozzles corresponding to the predetermined moving distance of the printer head.

The data adjuster may include a position sensor to detect a position of the printer head, a calculator to calculate a difference between a previous position of the printer head and a current position of the printer head, before and after the printer head moves, respectively, and a shifting unit to shift the image data by a number of nozzles corresponding to the calculated positional difference.

The calculator may generate shift pulses corresponding to the calculated positional difference, and the shifting unit may shift the image data using the generated shift pulses.

The position sensor may detect the position of the printer head every time a print medium is fed a distance corresponding to one print line.

The calculator may calculate a difference between a current position of the printer head detected by the position sensor, and a previous position corresponding to a previous print line every time the print medium is fed the distance corresponding to one print line.

The shifting unit may shift the image data by the number of nozzles corresponding to the positional difference calculated by the calculator every time the print medium is fed the distance corresponding to one print line.

The head vibration unit may include a cam to move the printer head.

The foregoing and/or other aspects and utilities of the present general inventive concept may also be achieved by providing a computer readable recording medium storing a computer readable program for executing the method of compensating for a defective nozzle of an inkjet image forming device.

The foregoing and/or other aspects and utilities of the present general inventive concept may also be achieved by providing an image forming apparatus, including a printer head comprising a nozzle unit having a plurality of nozzles to eject ink to form an image on a printing medium, and a defective nozzle compensation unit to compensate for a defective nozzle of the plurality of nozzles by moving the printer head in a first direction to change a position of the defective nozzle with respect to the printing medium, and by shifting image data corresponding to the plurality of nozzles in a second direction opposite to the first direction.

The first and second directions may each be perpendicular to a conveying direction of the printing medium. The defective nozzle compensation unit may include a head vibration unit to move the printer head a predetermined moving distance in the first direction to change the position of the defective nozzle with respect to the printing medium, and a data adjuster to detect the predetermined moving distance, and to shift the image data in the second direction by a number of nozzles corresponding to the detected moving distance.

The data adjuster may include a head vibration unit to move the printer head a predetermined moving distance in the first direction to change the position of the defective nozzle with respect to the printing medium, and a position sensor to detect positions of the printer head before and after the printer head is moved by the head vibration unit, and to output position information corresponding to the positions of the printer head, a calculator to calculate the predetermined moving distance of the printer head by calculating a difference between positions of the printer head using the position information output by the position sensor, and to generate shift pulses to shift the image data a number of nozzles corresponding to the calculated moving distance, and a shifting unit to shift the image data the number of nozzles corresponding to the calculated moving distance using the shift pulses generated by the calculator. The position sensor may include a bar code recognition sensor. The bar code recognition sensor may be attached to the printer head to move with the printer head to detect a position of the printer head by reading a fixed bar code containing positional information.

The apparatus may further include a defective nozzle detector to detect a presence and a position of the defective nozzle. The defective nozzle detector may detect an ejecting state of each nozzle of the plurality of nozzles and may store information on the determined ejecting states in the printer head. The information may include a nozzle position and a nozzle color of each nozzle of the plurality of nozzles. The defective nozzle detector may include a first detector to detect whether each nozzle of the plurality of nozzles is clogged by scanning light on the nozzle unit, and a second detector to detect the presence of the defective nozzle by scanning light on the printing medium having the printed image. The defective nozzle detector may detect the presence and the position of the defective nozzle by transmitting a nozzle check signal to each nozzle of the plurality of nozzles and by receiving a return signal in response to the nozzle check signal.

The apparatus may further include a driving unit to provide a driving force to the plurality of nozzles to eject the ink to form the image on the printing medium. The driving unit may include one of a thermal actuator and a piezoelectric actuator. The printer head may be a line-type printer head or an array type printer head.

The foregoing and/or other aspects and utilities of the present general inventive concept may also be achieved by providing a defective nozzle compensation unit to compensate for a defective nozzle of a printer head, the unit including a head vibration unit to move the printer head a predetermined moving distance in a first direction to change a position of the defective nozzle with respect to a printing medium, and a data adjuster to detect the predetermined moving distance and to shift image data corresponding to nozzles of the printer head in a second direction opposite to the first direction by a number of nozzles corresponding to the detected moving distance.

The foregoing and/or other aspects and utilities of the present general inventive concept may also be achieved by providing a method of compensating for a defective nozzle of a printer head, the method including moving the printer head a predetermined moving distance in a first direction to change a position of the defective nozzle, shifting image data corresponding to nozzles of the printer head by a number of nozzles corresponding to the predetermined moving distance in a second direction opposite to the first direction, and printing a print line of an image using the nozzles and the corresponding shifted image data.

The method may further include repeating the moving of the printer head, the shifting of the image data, and the printing operations until every print line of the image has been printed. The method may further include moving the printer head a second predetermined moving distance in the first direction to change the position of the defective nozzle, shifting the image data a second number of nozzles corresponding to the second predetermined moving distance in the second direction, and printing a subsequent line of the image using the nozzles and the corresponding twice shifted image data. The predetermined moving distance and the second predetermined moving distance may be the same, and the number of nozzles and the second number of nozzles may be the same. The method may further include moving the printer head a third predetermined moving distance in the second direction to change the position of the defective nozzle, shifting the image data a third number of nozzles corresponding to the third moving distance in the first direction, and printing another line of the image using the nozzles and the corresponding thrice shifted image data.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
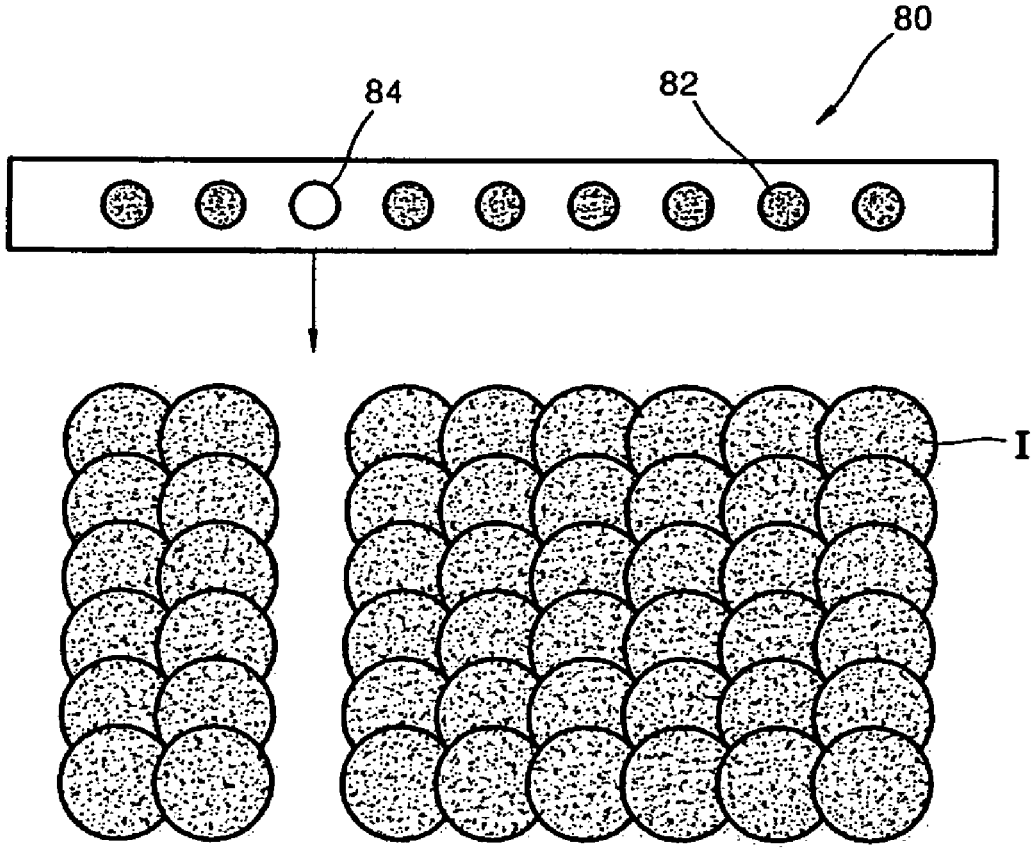
FIG. 1 (PRIOR ART)
FIG. 1 is a diagram illustrating a print pattern when a defective nozzle is included in a nozzle module of a conventional line printing inkjet image forming device.
Figure 2A:
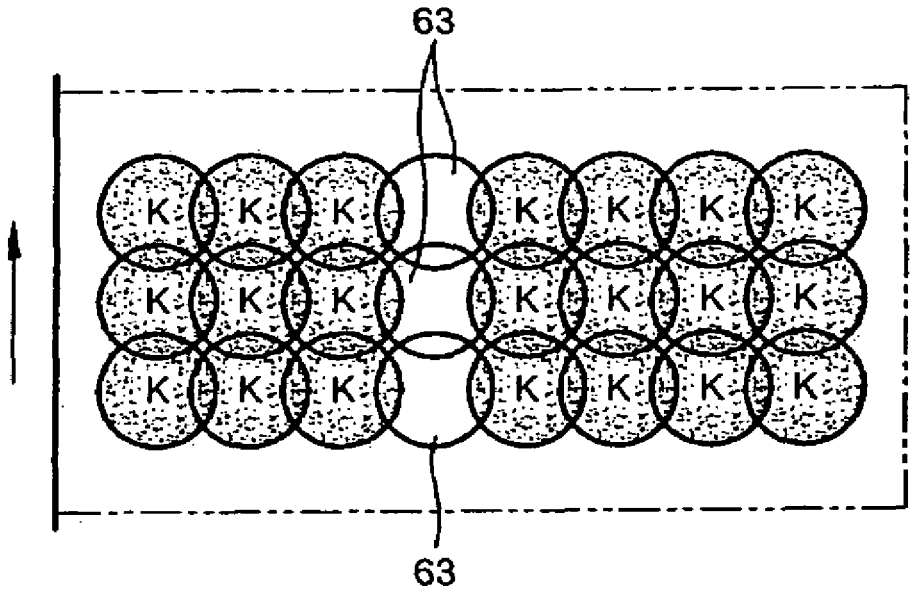
FIG. 2A (PRIOR ART)
FIGS. 2A through 2D are diagrams illustrating a conventional process of compensating for the defective nozzle of the conventional line printing inkjet image forming device illustrated in FIG. 1.
Figure 2B:
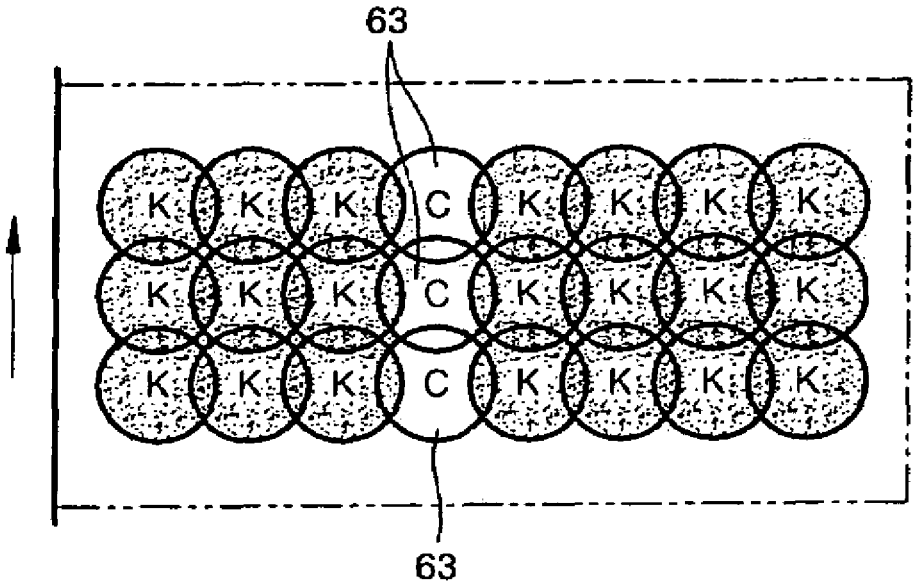
FIG. 2B (PRIOR ART)
Figure 2C:
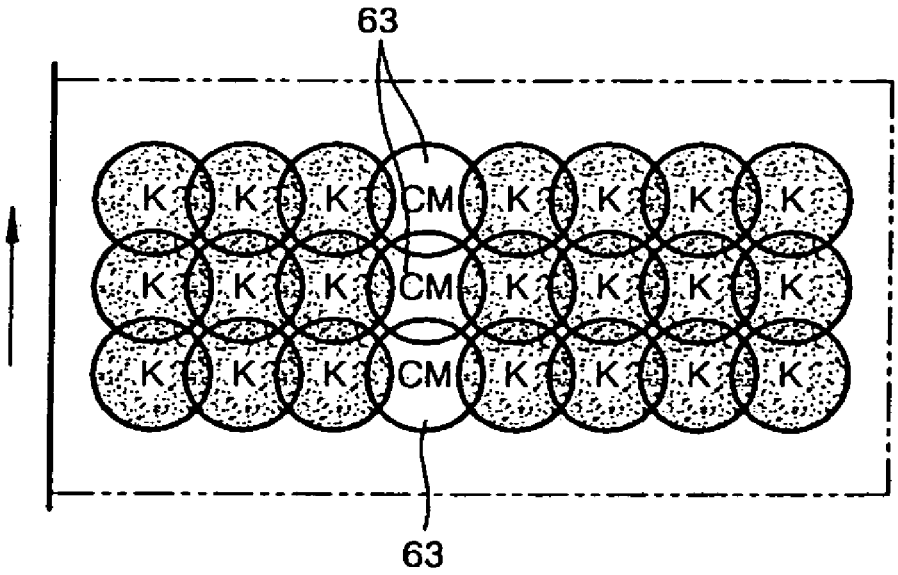
FIG. 2C (PRIOR ART)
Figure 2D:
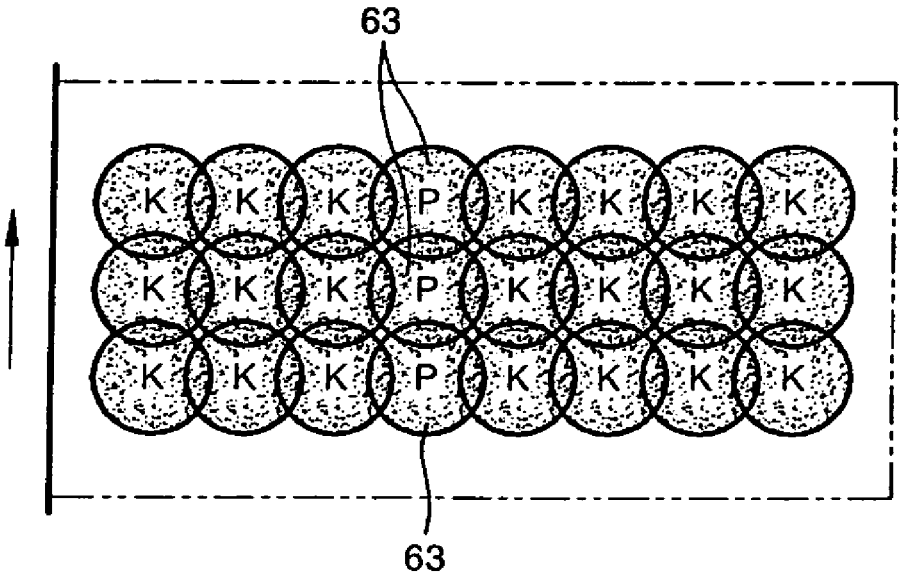
FIG. 2D (PRIOR ART)

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures. In the drawings, thicknesses of lines and sizes of components may be exaggerated for clarity and convenience of description.

Figure 3:
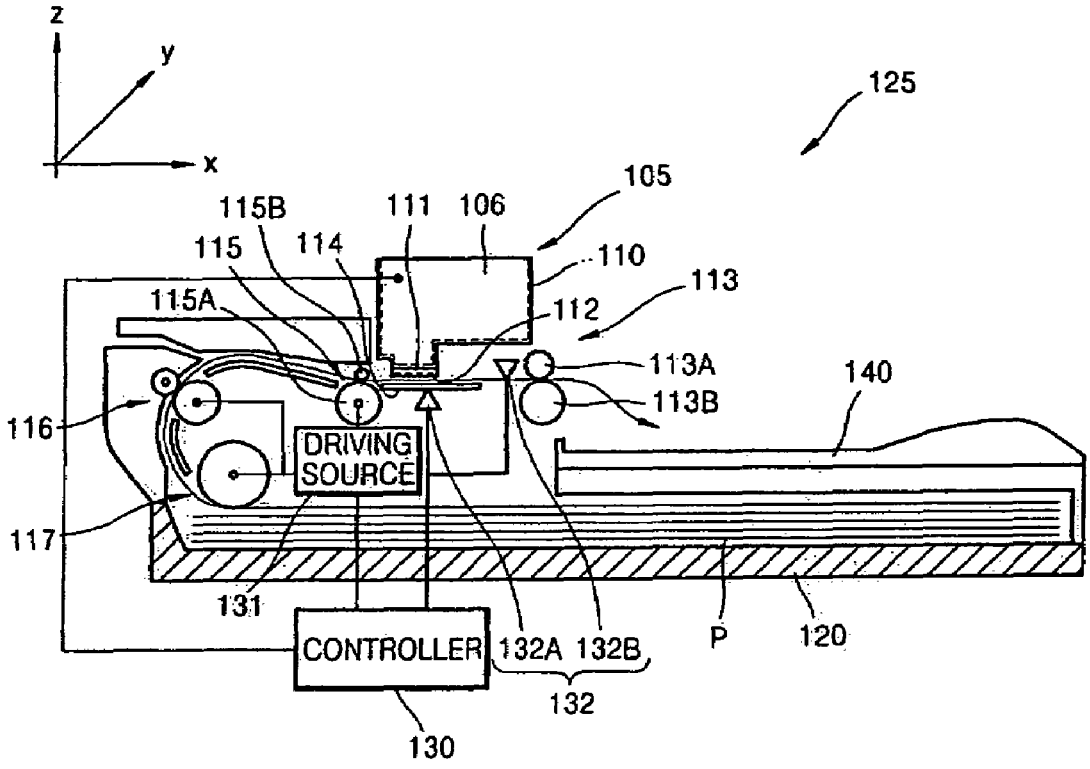
FIG. 3 is a cross sectional view illustrating an inkjet image forming device, according to an embodiment of the present general inventive concept.

FIG. 3 is a cross sectional view illustrating an inkjet image forming device 125, according to an embodiment of the present general inventive concept. Referring to FIG. 3, the inkjet image forming device 125 includes a paper feeding cassette 120, a printer head unit 105, a supporting member 114 facing the printer head unit 105, a defective nozzle detector 132 to detect the presence and position of a defective nozzle of a nozzle module 112, a print medium feeder to feed a print media P in a first (x) direction, and a paper loader 140 on which the print media P are discharged and loaded. The inkjet image forming device 125 also includes a driving unit 160 (see FIG. 4) and a controller 130 to control an operation of each component thereof.

The print media P are loaded in the paper feeding cassette 120. The print media P loaded in the paper feeding cassette 120 are fed to the paper loader 140 by the print medium feeder and pass by a printer head 111. The paper loader 140 is a part, such as a paper output tray, on which the print media P are discharged and loaded.

The print medium feeder feeds the print media P, loaded in the paper feeding cassette 120, along a predetermined path and includes, in the present embodiment, a pick-up roller 117, a pair of supplementary rollers 116, a feeding roller 115, and a discharge roller 113. The print medium feeder is driven by a driving source 131, such as a motor, and provides a feeding function to feed the print media P. Operation of the driving source 131 is controlled by the controller 130.

The pick-up roller 117 is disposed at one end of the paper feeding cassette 120 and picks up and draws the print media P one sheet at a time. The feeding roller 115 is disposed at an input side of the printer head 111 and feeds the print media P drawn by the pick-up roller 117 to the printer head 111. The feeding roller 115 may include a driving roller 115A to provide a feeding force to feed the print media P and an idle roller 115B elastically engageable with the driving roller 115A. The pair of supplementary rollers 116 to feed the print media P can also be disposed between the pick-up roller 117 and the feeding roller 115. The discharge roller 113 is disposed at an output side of the printer head 111 and discharges the printed print media P to an outside the inkjet image forming device 125. The discharge roller 113 may include a star wheel 113A disposed in the width direction of each print medium P and a supporting roller 113B to support a rear surface of the passing print medium P by facing the star wheel 113A. The star wheel 113A prevents the print medium P, fed under the nozzle module 112, from touching the nozzle module 112 or the bottom of a housing 110 of the printer head unit 105 or prevents a gap between the print medium P and the nozzle module 112 from varying. In addition, at least a portion of the star wheel 113A is disposed to protrude more than the nozzle module 112 and is point-contacted with a front surface of the print medium P. The print media P discharged from the inkjet image forming device 125 are discharged to the paper loader 140.

The supporting member 114 is disposed below the printer head 111 and supports the rear surface of each fed print medium P so that a predetermined gap is maintained between the nozzle module 112 and the print medium P. The gap between the nozzle module 112 and the print medium P may be about 0.5 mm to about 2.5 mm.

The defective nozzle detector 132 detects a defective nozzle created during manufacture of the printer head unit 105 or during a printing job. In addition, the defective nozzle detector 132 checks an ejecting state of the defective nozzle and adjacent nozzles. That is, the defective nozzle detector 132 may check an ejection state of each nozzle of the nozzle module 112 and store information on the checking result in a memory (not illustrated). Here, the defective nozzle is a nozzle that cannot normally eject ink, such as a dead nozzle which cannot eject ink or a weak nozzle which has a weakened ejecting function. That is, the defective nozzle is a nozzle from which no ink or less than a design specification required amount of ink is ejected due to one or more of a variety of reasons.

The defective nozzle might be created in a manufacture of the printer head 111 or during a printing job. Information on the defective nozzle generated in the manufacturing process may be separately stored in a memory (not illustrated) included in the printer head 111 and transmitted to the inkjet image forming device 125 when the printer head 111 is installed in the inkjet image forming device 125.

In general, printer heads of inkjet image forming devices are largely classified into two types according to a type of method used to provide a firing force to ink droplets: a heat driving method and a piezo driving method. In the heat driving method, bubbles are generated in ink using a heater and ink droplets are ejected using an expansive force of the bubbles. On the other hand, in the piezo driving method, ink droplets are ejected by pressure provided to ink due to a variation of a piezo element. In a case where ink is ejected using the heat driving method, a defective nozzle can be easily detected, which is generally created when the heater used to eject the ink has short circuited, when a driving circuit of the heater has malfunctioned, or when an electrical component, such as a field effect transistor (FET), has malfunctioned. Likewise, in a case where ink is ejected by the piezo driving method, a defective nozzle can also be easily detected, which is generally created when the piezo element has malfunctioned or when a driving circuit to drive the piezo element has malfunctioned.

In addition to the above causes, there are other causes of a defective nozzle, such as a nozzle that is clogged by a foreign object, which cannot be easily detected. If a cause of a defective nozzle cannot be easily detected, a test page is printed. When a defective nozzle is present, a print density on a part of a print medium printed by the defective nozzle is lower than a print density on a part of the print medium printed by a normal nozzle because of missing dots (i.e., ink dots that were not printed by the defective nozzle). Thus, a presence and position of a defective nozzle can be detected by observing density differences of ink of an image printed on a print medium.

In the present embodiment, the defective nozzle detector 132 includes a first detector 132A and a second detector 132B. The first detector 132A detects whether a hole of each nozzle is clogged by scanning light on the nozzle module 112, and the second detector 132B detects whether a defective nozzle is present by scanning light on a fed print medium P. The defective nozzle detector 132 may include, for example, a photo sensor. The photo sensor may include a light emitting device (e.g., a light emitting diode) to scan light on the nozzle module 112 or the print medium P and a photo detector to detect light reflected from the nozzle module 112 or the print medium P. The defective nozzle detector 132 detects whether a defective nozzle is present by analyzing an output signal of the photo detector and transmits information on the detection result to the controller 130. The light emitting device and the photo detector can be implemented in one body or can be separate. Since the configuration and operation of the photo sensor is understood by those of ordinary skill in the art, a detailed description of the photo sensor is omitted.

In another embodiment, the defective nozzle detector 132 can detect the presence and position of a defective nozzle by transmitting a nozzle check signal to each nozzle of the printer head 111 and by receiving a signal in response to the nozzle check signal.

Since this method of detecting a defective nozzle is understood by those of ordinary skill in the art, a detailed description of the method is omitted. Furthermore, various previously disclosed apparatuses and methods could be used to detect the generation and a position of a defective nozzle.

The defective nozzle detector 132 detects the presence and position of a defective nozzle using a series of processes described above, and information on the defective nozzle detected by the defective nozzle detector 132 may be stored in the memory (not illustrated). The controller 130 controls operations of components to compensate for the defective nozzle based on the defective nozzle information. The defective nozzle information contains a position where the defective nozzle is present and a color of ink that should be ejected by the defective nozzle.

The printer head unit 105 prints an image by ejecting ink onto a print medium P and may include the housing 110, the printer head 111 disposed at one end of the housing 110, the nozzle module 112 included in the printer head 111, and a carriage 106 to which the housing 110 is mounted as a cartridge type housing 110. The feeding roller 115 is disposed to rotate at an input side of the nozzle module 112, and the discharge roller 113 is disposed to rotate at an output side of the nozzle module 112.

An ink reservoir (not illustrated) is included in the housing 110. In addition, the housing 110 can also include chambers in which a driving unit 160 (e.g., a piezo element for a piezo driving method or a heater for a heat driving method) (see FIG. 4) is disposed and connected to each nozzle of the nozzle module 112 to provide a driving force to eject ink, flow paths (e.g., orifices) to supply ink accommodated in the housing 110 to the chambers, a manifold, which is a common flow path to supply ink flowing in through the flow paths to the chambers, and restrictors, which are individual flow paths to supply ink to respective chambers. Since the chamber, the flow path, the manifold, and the restrictor are understood by those of ordinary skill in the art, a detailed description of these components is omitted. The ink reservoir to accommodate ink may be disposed separately from the printer head unit 105. In this case, the ink accommodated in the ink reservoir is supplied to the printer head unit 105 through a supply element, such as a pipe.

Figure 4:
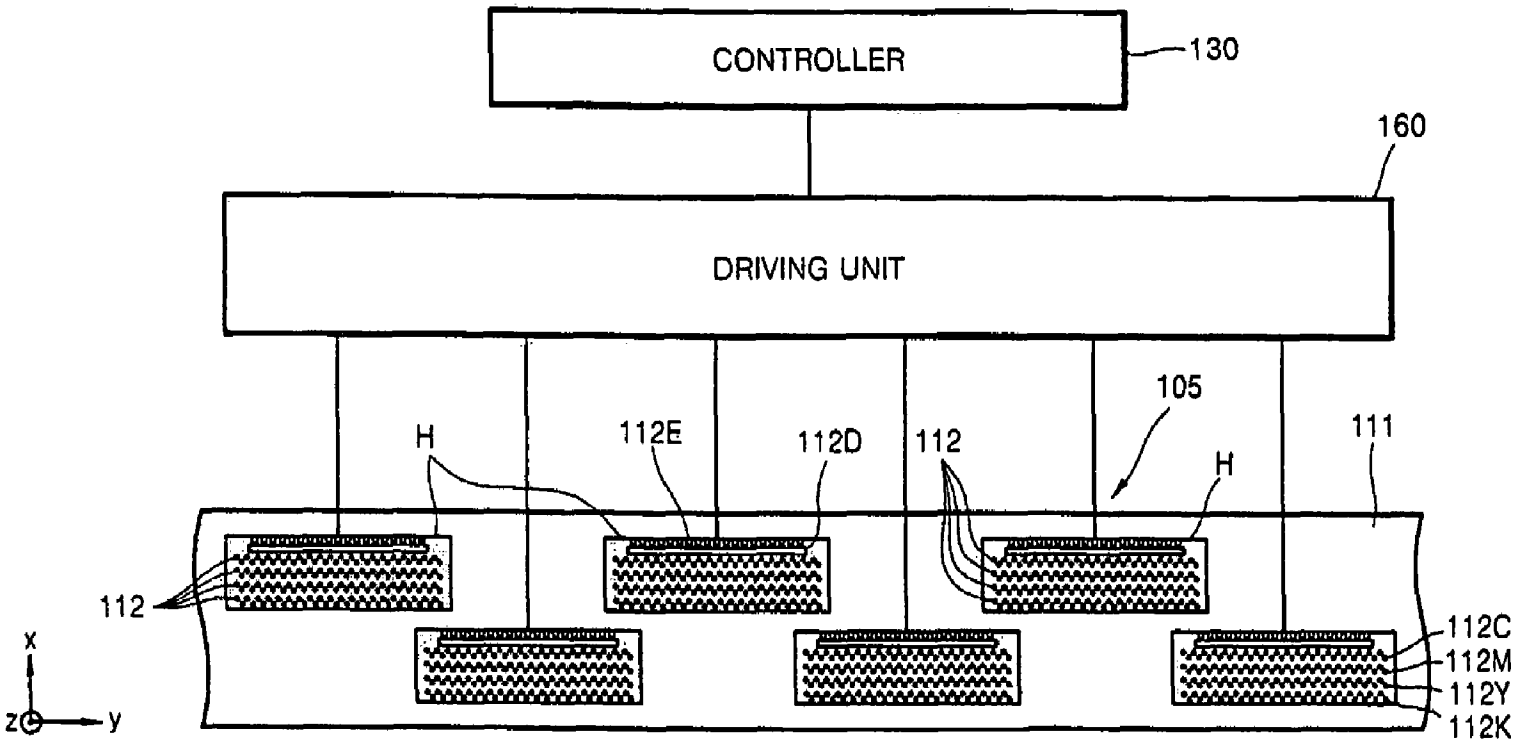
FIG. 4 is a block diagram illustrating a head driving module to drive a printer head which includes a plurality of nozzles, according to an embodiment of the present general inventive concept.

FIG. 4 is a block diagram illustrating a head driving module to drive the printer head 111, which includes a plurality of nozzles, according to an embodiment of the present general inventive concept. A method of driving the printer head 111 will now be described with reference to FIG. 4.

The driving unit 160 provides a driving force to eject ink droplets and prints an image on a print medium P by driving the nozzle module 112 at a predetermined frequency. The driving unit 160 may be classified into two types according to a method used to provide a firing force to ink droplets: a heat driving method of ejecting ink droplets using a thermal actuator (e.g., a heater), and a piezo driving method of ejecting ink droplets using a piezoelectric actuator (e.g., a piezo element). A driving operation to drive each nozzle of the driving unit 160 is controlled by the controller 130.

In general, the printer head 111 operates using a shuttle method (which prints an image by shuttling in a direction perpendicular to a feeding direction of the print medium P) or a line printing method (which uses a printer head having a nozzle module of a length equal to a width of the print medium P). The present general inventive concept can be applied to inkjet image forming devices of the shuttle method or the line printing method. For convenience of description, a printer head of the line printing method will be described.

The printer head 111 is disposed in a second (y) direction and the print medium P is fed in a first (x) direction. The printer head 111 can use the thermal actuator (e.g., the heater) or the piezoelectric actuator (e.g., the piezo element) to provide a driving force to eject ink and is manufactured to have a high resolution by a semiconductor fabrication process including etching, evaporation, and sputtering. The printer head 111 includes the nozzle module 112 to print an image by ejecting ink onto the print medium P.

The nozzle module 112 can be formed to have a length corresponding to the width of the print medium P or a length longer than the width of the print medium P. As illustrated in FIG. 4, the printer head 111 can include a plurality of head chips H in which a plurality of nozzle rows 112C, 112M, 112Y, and 112K are formed. Here, 112C denotes a cyan nozzle row, 112M denotes a magenta nozzle row, 112Y denotes a yellow nozzle row, and 112K denotes a black nozzle row. The plurality of head chips H can be manufactured as a single chip having a length corresponding to the width of the print medium P.

Although the line printing printer head 111 having the nozzle module 112 including the plurality of head chips H is illustrated in the present embodiment, the printer head 111 can have a variety of configurations. For example, the inkjet image forming device according to an embodiment of the present general inventive concept may include a shuttle printer head. That is, the printer head 111 and the nozzle module 112 are only exemplary embodiments of a printer head and a nozzle module of the present general inventive concept, and do not limit the scope of the present general inventive concept.

A driving circuit 112D and a cable 112E, through which a driving signal from the controller 130, power to eject ink, and image data are provided, are connected to each nozzle of the nozzle module 112. For the cable 112E, a flexible cable, such as a flexible printed circuit (FPC) or a flexible flat cable (FFC), may be used.

Figure 5:
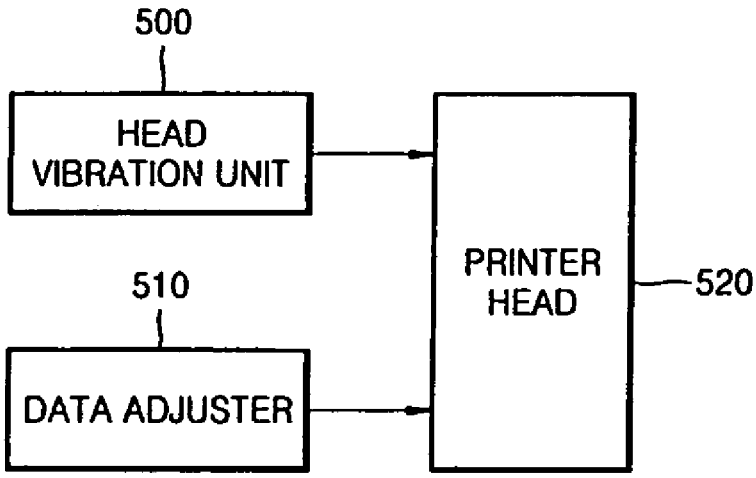
FIG. 5 is a block diagram illustrating an apparatus to compensate for a defective nozzle of an inkjet image forming device, according to an embodiment of the present general inventive concept.
Figure 9:
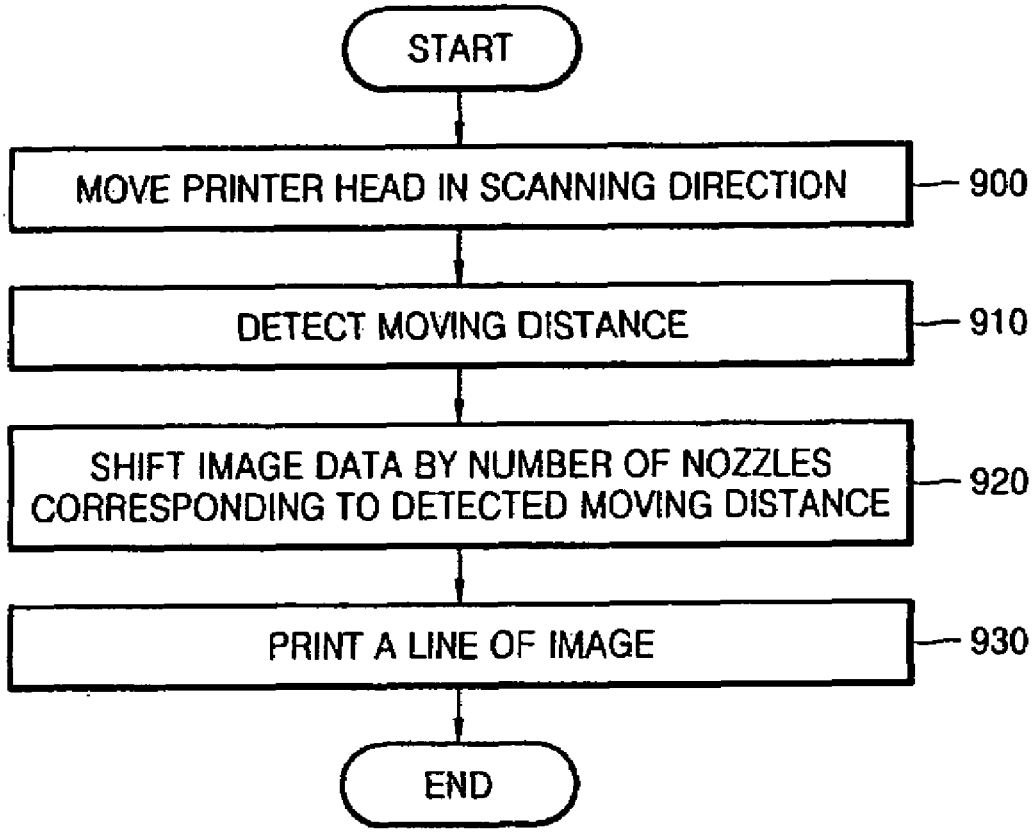
FIG. 9 is a flowchart illustrating a method of compensating for a defective nozzle of an inkjet image forming device, according to an embodiment of the present general inventive concept.

FIG. 5 is a block diagram illustrating an apparatus to compensate for a defective nozzle of an inkjet image forming device, according to an embodiment of the present general inventive concept. The apparatus illustrated in FIG. 5 includes a head vibration unit 500 and a data adjuster 510. FIG. 9 is a flowchart illustrating a method of compensating for a defective nozzle of an inkjet image forming device, according to an embodiment of the present general inventive concept. An operation of the apparatus illustrated in FIG. 5 will now be described in conjunction with the method of compensating for a defective nozzle of an inkjet image forming device illustrated in FIG. 9.

Referring to FIGS. 5 and 9, in operation 900, the head vibration unit 500 moves a printer head 520 a predetermined distance in a scanning direction. The moving distance may be set by a user or a manufacturer of the inkjet image forming device, and the printer head 520 may be moved by a cam (not illustrated). The cam is a driving body and makes a following body move up and down or side to side. The cam can be, for example, a planar cam, which has an outline or recess shown as a planar curve, or a solid cam, which has an outline or recess shown as a spatial curve. The scanning direction is a direction perpendicular to a sub-scanning direction as illustrated in FIG. 7B. Here, the sub-scanning direction is a direction in which paper is fed, and the scanning direction is a left and right direction of the printer head 520.

A position of a defective nozzle is changed by moving the printer head 520 in the scanning direction to change a print position printed by the defective nozzle relative to the print medium P. In the case of a wide array printer head, since a width of a printable area by nozzles included in the wide array printer head is wider than the width of the print medium P, an image can be printed on the print medium by moving the wide array printer head in the scanning direction within a range corresponding to the spare (e.g., back-up) nozzles (i.e., the nozzles included on portions of the wide array print head that extend beyond the width of the print medium P).

In operation 910, the data adjuster 510 detects a moving distance of the printer head 520. In operation 920, the data adjuster 510 shifts image data corresponding to the nozzles in a direction opposite to the moving direction of the printer head 520 by a number of nozzles corresponding to the detected moving distance.

Figure 7A:
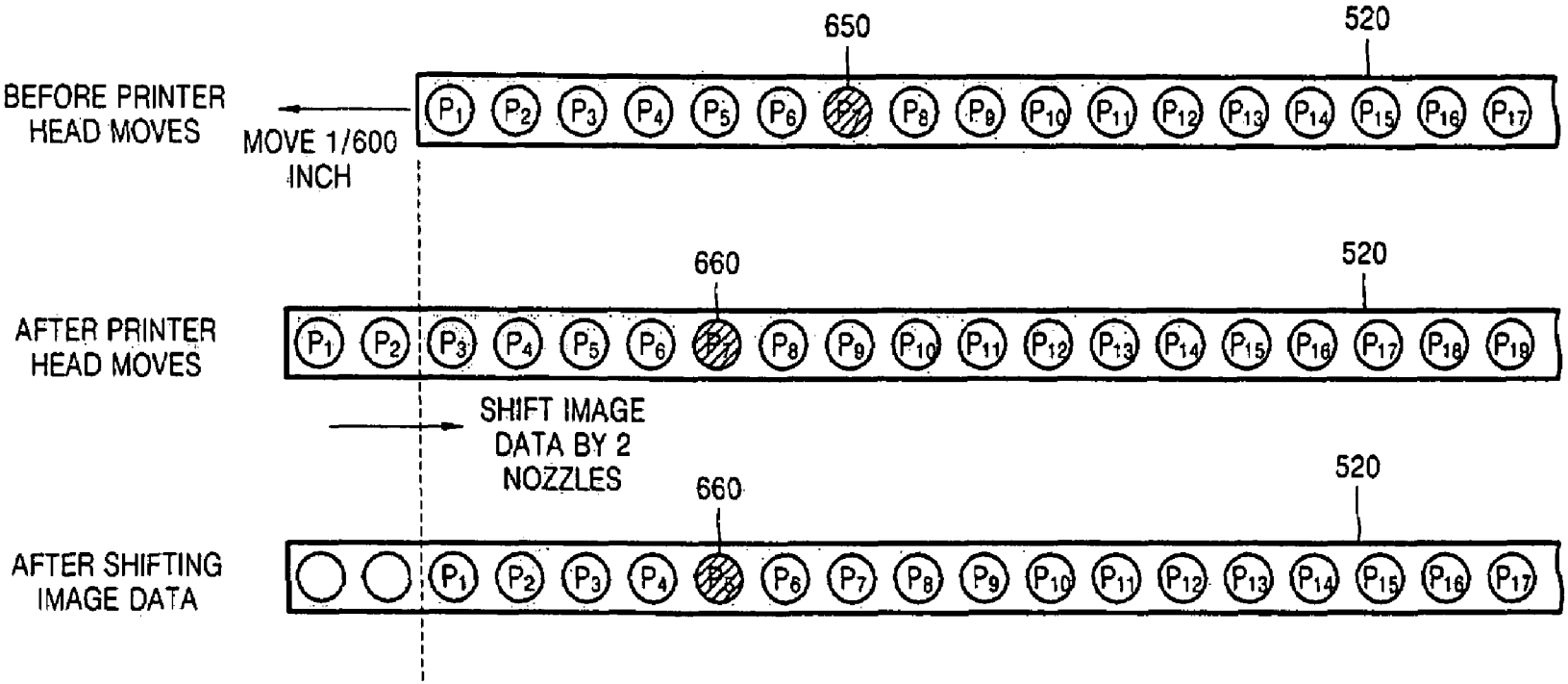
FIG. 7A is a conceptual diagram illustrating a method of moving a printer head and shifting image data, according to an embodiment of the present general inventive concept.
Figure 7B:
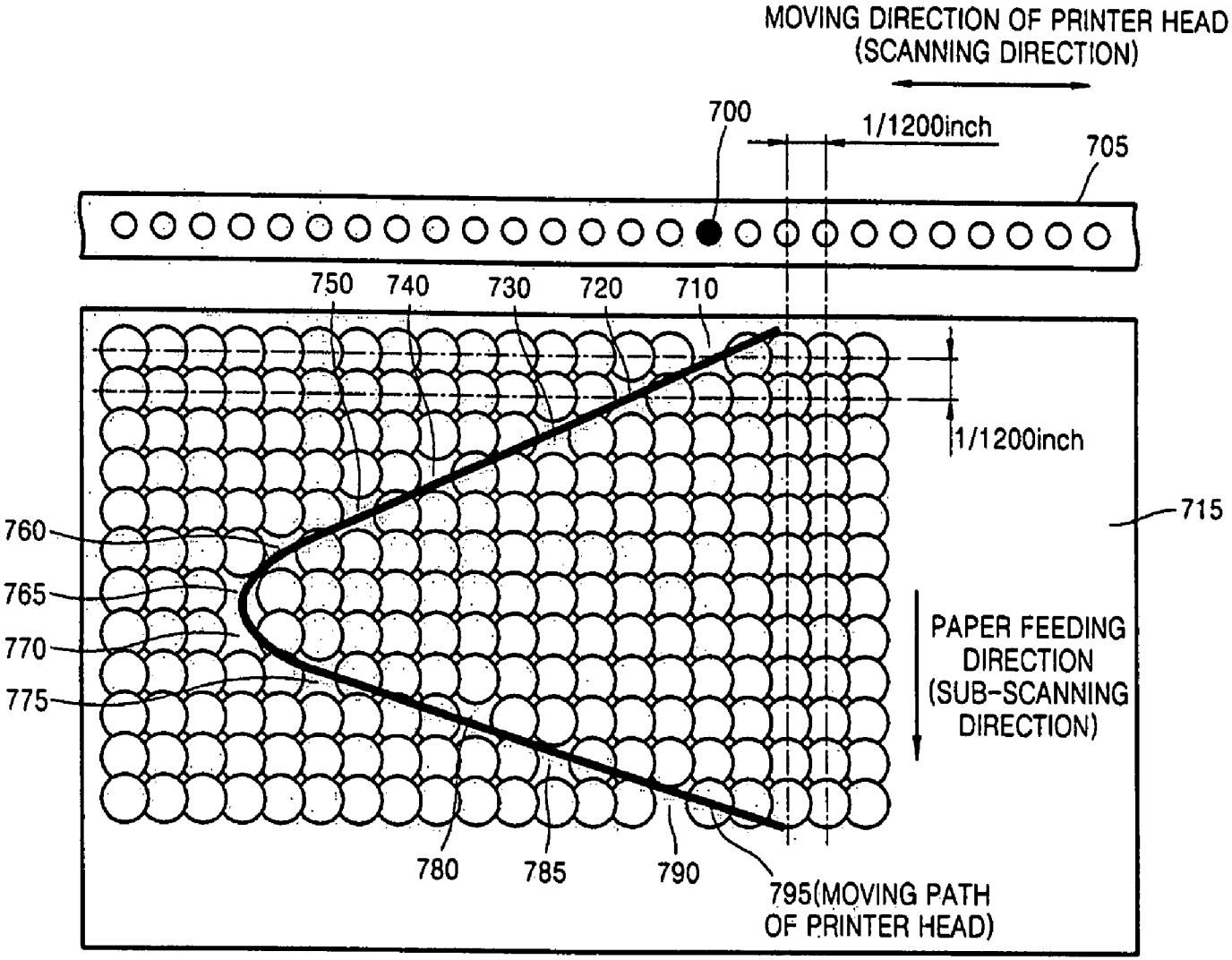
FIG. 7B is a conceptual diagram illustrating a print image obtained by distributing print positions of a defective nozzle by an apparatus to compensate for a defective nozzle of an inkjet image forming device, according to an embodiment of the present general inventive concept.

FIG. 7A is a conceptual diagram illustrating a method of moving the printer head 520 and shifting the image data by a moving distance of the printer head 520, according to an embodiment of the present general inventive concept. In FIG. 7A, each circle of the printer head 520 denotes a nozzle included in the printer head 520, and $P_1$, $P_2$, $P_3$, etc., each denotes image data of a corresponding nozzle. The printer head 520 illustrated in FIG. 7A has print resolution of 1200 dpi (dot per inch). When the printer head 520 is moved to the left of the scanning direction by 1/600 inch, since a number of nozzles corresponding to 1/600 inch (which is the moving distance of the printer head 520) is 2, the data adjuster 510 shifts all of the image data $P_1$, $P_2$, $P_3$, etc., to the right (i.e., a direction opposite to the moving direction of the printer head 520) by two nozzles.

As illustrated in FIG. 7A, even though a print position printed by a defective nozzle is changed from a first print position 650 to a second print position 660 due to the movement of the printer head 520, a print position of each piece of image data is the same before and after the printer head 520 moves because the image data is shifted. In particular, as illustrated in FIG. 7A, before the printer head 520 moves, a left-most nozzle of the printer head 520 includes the image data $P_1$. After the printer head 520 moves to the left of the scanning direction by 1/600 inch (the moving distance corresponding to two nozzles) and before the image data is shifted, the left-most nozzle of the printer heat 520 still includes the image data $P_1$. However, the image data, including the image data $P_1$, is then shifted two nozzles to the right (corresponding to the moving distance of the printer head 520 to the left) such that a third nozzle from the left (i.e., a nozzle that is two nozzles to the right of the left-most nozzle) includes the image data $P_1$.

In operation 930, the printer head 520 receives the shifted image data and prints a single print line of the image by driving the nozzles.

Thus, to print all print lines of the image, a process of moving the printer head 520 after printing a print line of the image, shifting the image data in a direction opposite to the moving direction of the printer head 520 by the moving distance, and printing a subsequent print line of the image is repeatedly performed. Therefore the print position of the defective nozzle can be distributed in every print line, thereby reducing a degradation of visual print quality resulting from the defective nozzle.

Figure 6:
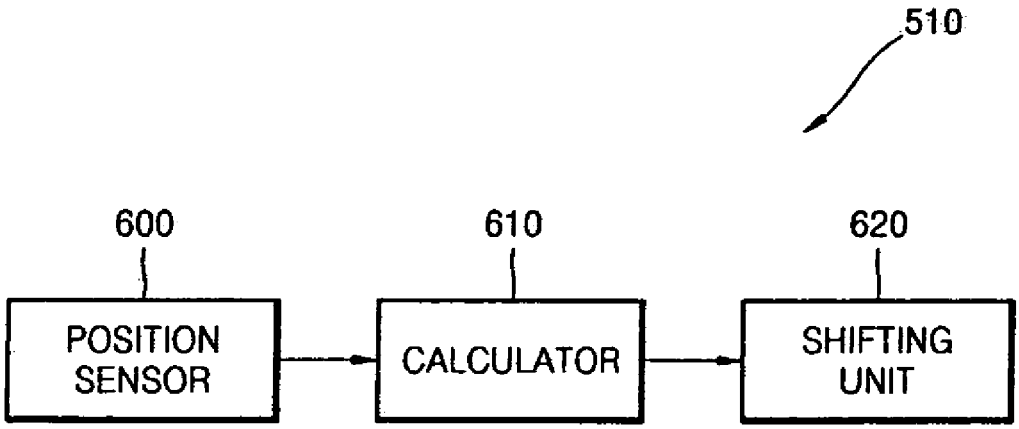
FIG. 6 is a block diagram illustrating a data adjuster of the apparatus illustrated in FIG. 5, according to an embodiment of the present general inventive concept.

FIG. 6 is a block diagram illustrating the data adjuster 510 illustrated in FIG. 5, according to an embodiment of the present general inventive concept. Referring to FIG. 6, the data adjuster 510 includes a position sensor 600, a calculator 610, and a shifting unit 620.

The position sensor 600 detects positions of the printer head 520 before and after the printer head 520 moves and outputs the detected positions to the calculator 610. The position sensor 600 may be, for example, a sensor to detect a position of the printer head 520 using a barcode. That is, a barcode recognition sensor may be attached to the printer head 520 or a carriage including the printer head 520 to move with the printer head 520 or the carriage, and the position sensor 600 may detect a position of the printer head 520 by reading a barcode containing positional information attached in a fixed location.

The calculator 610 obtains a moving distance of the printer head 520 by calculating a difference between the positions of the printer head 520 before and after the printer head 520 moves, which are input from the position sensor 600, and generates shift pulses to shift image data by a number of nozzles corresponding to the obtained moving distance. The shifting unit 620 receives the generated shift pulses and shifts the image data corresponding to each nozzle.

FIG. 7B is a conceptual diagram illustrating a print image obtained by distributing print positions of a defective nozzle by an apparatus to compensate for a defective nozzle of an inkjet image forming device, according to an embodiment of the present general inventive concept. In FIG. 7B, print resolutions in a scanning direction and a sub-scanning direction are 1200 dpi. A printer head 705 is moved along a pre-set moving path 795. A difference between positions of the printer head 705 in a previous print line and a current print line, i.e., a moving distance, is detected every time the printer head 705 is positioned in a new print line according to a feeding of a print medium 715, and image data is correspondingly shifted by the detected moving distance.

As illustrated in FIG. 7B, by moving the printer head 705, print positions printed by a defective nozzle 700 are distributed to print positions 710, 720, 730, 740, 750, 760, 765, 770, 775, 780, 785, and 790. In this case, by shifting the image data in a direction opposite to the moving direction of the printer head 705 by the moving distance of the printer head 705, the image printed on the print medium 715 is not affected by the movement of the printer head.

Figure 8:
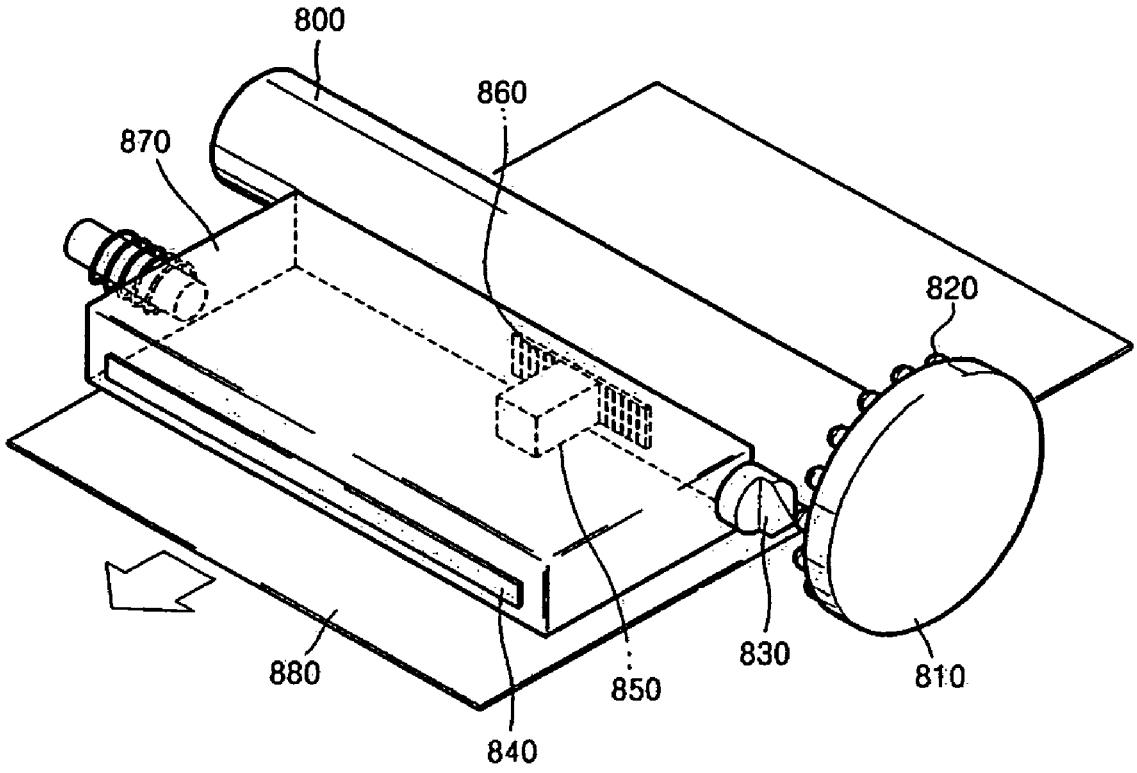
FIG. 8 is a perspective view illustrating an inkjet image forming device including an apparatus to compensate for a defective nozzle, according to an embodiment of the present general inventive concept.

FIG. 8 is a perspective view illustrating an inkjet image forming device including an apparatus to compensate for a defective nozzle, according to an embodiment of the present general inventive concept. Referring to FIG. 8, a platen roller 800 is rotatable by a platen roller gear cam 820 attached to a roller gear box 810. A carriage 840 including a printer head 870 is moved left and right in a scanning direction by an array head cam 830, in synchronization with a moving speed of a print medium 880.

A position sensor 850 attached to the carriage 840 moves with the carriage 840 and detects a position of the printer head 870 by sensing a fixed barcode 860.

The general inventive concept can also be embodied as computer readable codes on a computer readable recording medium. The computer readable recording medium is any data storage device that can store data which can be thereafter read by a computer system. Examples of the computer readable recording medium include, but are not limited to, a read-only memory (ROM), a random-access memory (RAM), CD-ROMs, magnetic tapes, floppy disks, optical data storage devices, and carrier waves (such as data transmission through the Internet).

As described above, in a method and apparatus to compensate for a defective nozzle of an inkjet image forming device, according to the embodiments of the present general inventive concept, degradation of print image quality, such as a white band easily recognized by a user, can be prevented in a print image by distributing print positions of the defective nozzle by moving a printer head left and right in a scanning direction, and a life span of the printer head can be extended by compensating for the defective nozzle.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A method of compensating for a degradation of print image quality due to a defective nozzle included in a printer head of an inkjet image forming device, the method comprising:

moving the printer head by a predetermined distance in a scanning direction;

shifting image data corresponding to nozzles of the printer head in a direction opposite to the moving direction of the printer head by a number of nozzles corresponding to the predetermined moving distance of the printer head; and printing an image by driving the nozzles according to the shifted image data.

2. The method of claim 1, further comprising:

detecting an initial position of the printer head before the printer head moves, wherein the shifting of the image data comprises:

detecting a current position of the printer head after the printer head moves;

calculating a difference between the detected initial position and the detected current position; and shifting the image data by a number of nozzles corresponding to the calculated positional difference.

3. The method of claim 2, wherein the shifting of the image data by the number of nozzles corresponding to the calculated positional difference comprises:

generating shift pulses corresponding to the calculated positional difference; and shifting the image data using the generated shift pulses.

4. The method of claim 1, further comprising:

repeating the moving of the printer head, the shifting of the image data, and the printing of the image operations in units of print lines until all print lines of the image are printed.

5. An apparatus to compensate for a degradation of print image quality due to a defective nozzle included in a printer head of an inkjet image forming device, the apparatus comprising:

a head vibration unit to move a printer head a predetermined distance in a scanning direction; and a data adjuster to shift image data to be printed corresponding to nozzles of the printer head in a direction opposite to the moving direction of the printer head by a number of nozzles corresponding to the predetermined moving distance of the printer head.

6. The apparatus of claim 5, wherein the data adjuster comprises:

a position sensor to detect a position of the printer head;

a calculator to calculate a difference between a previous position of the printer head and a current position of the printer head before and after the printer head moves, respectively; and a shifting unit to shift the image data by a number of nozzles corresponding to the calculated positional difference.

7. The apparatus of claim 6, wherein:

the calculator generates shift pulses corresponding to the calculated positional difference; and the shifting unit shifts the image data using the generated shift pulses.

8. The apparatus of claim 6, wherein the position sensor detects the position of the printer head every time a print medium is fed a distance corresponding to one print line.

9. The apparatus of claim 8, wherein the calculator calculates a difference between the current position of the printer head detected by the position sensor and a previous position corresponding to a previous print line every time the print medium is fed the distance corresponding to one print line.

10. The apparatus of claim 9, wherein the shifting unit shifts the image data by the number of nozzles corresponding to the positional difference calculated by the calculator every time the print medium is fed the distance corresponding to one print line.

11. The apparatus of claim 5, wherein the head vibration unit comprises:

a cam to move the printer head.

12. A computer readable recording medium including a computer readable program to perform a method of compensating for a degradation of print image quality due to a defective nozzle included in a printer head of an inkjet image forming device, the method comprising:

moving the printer head a moving distance in a scanning direction;

shifting image data corresponding to nozzles of the printer head in a direction opposite to the moving direction of the printer head by a number of nozzles corresponding to the moving distance of the printer head; and printing an image by driving the nozzles according to the shifted image data.

13. An image forming apparatus, comprising:

a printer head comprising a nozzle unit having a plurality of nozzles to eject ink to form an image on a printing medium; and a defective nozzle compensation unit to compensate for a defective nozzle of the plurality of nozzles by moving the printer head in a first direction to change a position of the defective nozzle with respect to the printing medium, and by shifting image data corresponding to the plurality of nozzles in a second direction opposite to the first direction.

14. The apparatus of claim 13, wherein the first and second directions are each perpendicular to a conveying direction of the printing medium.

15. The apparatus of claim 13, wherein the defective nozzle compensation unit comprises:

a head vibration unit to move the printer head a predetermined moving distance in the first direction to change the position of the defective nozzle with respect to the printing medium; and a data adjuster to detect the predetermined moving distance, and to shift the image data in the second direction by a number of nozzles corresponding to the detected moving distance.

16. The apparatus of claim 13, wherein the data adjuster comprises:

a head vibration unit to move the printer head a predetermined moving distance in the first direction to change the position of the defective nozzle with respect to the printing medium; and a position sensor to detect positions of the printer head before and after the printer head is moved by the head vibration unit, and to output position information corresponding to the positions of the printer head;

a calculator to calculate the predetermined moving distance of the printer head by calculating a difference between positions of the printer head using the position information output by the position sensor, and to generate shift pulses to shift the image data a number of nozzles corresponding to the calculated moving distance; and a shifting unit to shift the image data the number of nozzles corresponding to the calculated moving distance using the shift pulses generated by the calculator.

17. The apparatus of claim 16, wherein the position sensor comprises a bar code recognition sensor.

18. The apparatus of claim 13, further comprising:

a defective nozzle detector to detect a presence and a position of the defective nozzle.

19. The apparatus of claim 18, wherein the defective nozzle detector detects an ejecting state of each nozzle of the plurality of nozzles and stores information on the determined ejecting states in the printer head.

20. The apparatus of claim 19, wherein the information comprises a nozzle position and a nozzle color of each nozzle of the plurality of nozzles.

21. The apparatus of claim 18, wherein the defective nozzle detector comprises:

a first detector to detect whether each nozzle of the plurality of nozzles is clogged by scanning light on the nozzle unit; and a second detector to detect the presence of the defective nozzle by scanning light on the printing medium having the printed image.

22. The apparatus of claim 18, wherein the defective nozzle detector detects the presence and the position of the defective nozzle by transmitting a nozzle check signal to each nozzle of the plurality of nozzles and by receiving a return signal in response to the nozzle check signal.

23. A defective nozzle compensation unit to compensate for a defective nozzle of a printer head, the unit comprising:

a head vibration unit to move the printer head a predetermined moving distance in a first direction to change a position of the defective nozzle with respect to a printing medium; and a data adjuster to detect the predetermined moving distance and to shift image data corresponding to nozzles of the printer head in a second direction opposite to the first direction by a number of nozzles corresponding to the detected moving distance.

24. A method of compensating for a defective nozzle of a printer head, the method comprising:

moving the printer head a predetermined moving distance in a first direction to change a position of the defective nozzle;

shifting image data corresponding to nozzles of the printer head by a number of nozzles corresponding to the predetermined moving distance in a second direction opposite to the first direction; and printing a print line of an image using the nozzles and the corresponding shifted image data.

25. The method of claim 24, further comprising:

repeating the moving of the printer head, the shifting of the image data, and the printing operations until every print line of the image has been printed.

* * * * *